US007438618B1

(12) United States Patent
Lam

(10) Patent No.: US 7,438,618 B1
(45) Date of Patent: Oct. 21, 2008

(54) FLOTATION DEVICE

(75) Inventor: Ying Lung Lam, FoTan (HK)

(73) Assignee: D&S Toys Company Limited, Fo Tan (HK)

( * ) Notice: Subject to any disclaimer, the term of this patent is extended or adjusted under 35 U.S.C. 154(b) by 72 days.

(21) Appl. No.: 11/119,144

(22) Filed: Apr. 29, 2005

(51) Int. Cl.
*B63B 35/81* (2006.01)
*B63B 1/00* (2006.01)

(52) U.S. Cl. ..... 441/74; 441/79

(58) Field of Classification Search ..... 441/65, 441/74, 129
See application file for complete search history.

(56) References Cited

U.S. PATENT DOCUMENTS

| | | | | |
|---|---|---|---|---|
| 4,739,723 | A | 4/1988 | Plucknett | |
| 5,000,673 | A | 3/1991 | Bach et al. | |
| 5,603,645 | A * | 2/1997 | Saccomanno | 441/65 |
| 5,647,784 | A | 7/1997 | Moran | |
| 5,658,179 | A * | 8/1997 | Glydon et al. | 441/74 |
| 5,797,779 | A * | 8/1998 | Stewart | 441/74 |
| 5,988,377 | A | 11/1999 | Pugel et al. | |
| 6,106,345 | A | 8/2000 | Yeh | |
| 6,348,167 | B1 | 2/2002 | Chen | |
| 6,394,864 | B2 * | 5/2002 | Scharl | 441/65 |
| 6,712,657 | B1 | 3/2004 | Echecopar | |
| 6,955,576 | B2 * | 10/2005 | Yeh | 441/65 |
| 7,261,050 | B2 * | 8/2007 | Brauers et al. | 114/357 |
| 2003/0068938 | A1 | 4/2003 | Fireman | |

FOREIGN PATENT DOCUMENTS

| | | |
|---|---|---|
| WO | 97/29011 | 8/1997 |

* cited by examiner

*Primary Examiner*—Jesús D Sotelo
(74) *Attorney, Agent, or Firm*—Dilworth & Barrese, LLP

(57) ABSTRACT

An aquatic flotation device includes an outer covering having a first side and a second side formed of a polymeric sheet and substantially continuously joined together to retain foamed material such that the covering is under tension. The first side and polymeric sheet are each continuously joined along an edge portion interconnecting the first and second sides, e.g., by stitching. The edge portion overlaps an outer surface or edge of the polymeric sheet in finished condition.

5 Claims, 5 Drawing Sheets

FLOTATION DEVICE

BACKGROUND OF THE INVENTION

The present invention generally relates to an aquatic device such as a recreational or safety flotation body board having a cover and a method for manufacturing the same.

Swimmers and wave riders often utilize flotation devices to reduce effort needed to stay afloat and facilitate riding waves. Numerous types of flotation devices are available, ranging from complex, expensive surfboards to ride high waves off ocean beaches, flotation boards used for rescue by life guards and relatively simple body boards formed from exposed foam. For example, WO 97/29011 to Moran discloses a body board 12 formed by bonding a core 14 of polypropylene foam to a polymeric outer covering 24, 26 using an adhesive heat-shrinkable terpolymer thin film 36. Preferred outer coverings 24, 26 are formed from polyethylene for the upper skin 24 and a friction-reducing covering such as Surlyn® for the lower skin 26. U.S. Pat. No. 6,348,167 to Chen discloses a method of making a surfboard having a unitary structure from a foamed polymeric material.

U.S. Pat. No. 6,106,345 to Yeh discloses a body board 20 made of expanded polyethylene foam with graduated cell sizes having a protective layer 21 heat-laminated to the foam. The protective layer 21 includes antioxidants and ultraviolet inhibitors to protect the foam 20 from degradation. U.S. Pat. No. 4,739,723 to Plucknett discloses a hard protective lower layer 4 for body boards 1 useful to protect the board 1 from damage and also increase speed over water. The hard protective layer 4 is affixed to the board 1 using a plurality of cooperating threaded fasteners 22, 23 that are disposed through holes 21 in the board 1.

U.S. Pat. Pub. No. 2003/0068938 A1 to Fireman discloses a body board 10 that deforms under user's contact and formed from discrete, spaced-apart foam flotation members 12, 14, 16 joined by stitching a cloth cover 22 over and between the foam flotation members 12, 14, 16. Additionally, U.S. Pat. No. 6,712,657 to Echecopar discloses a process for manufacturing a surfboard 10 which includes cutting a board blank 20 from polystyrene, longitudinally-cutting the blank 20 in half, mounting an elongate reinforcement member 52 between the halves, shaping the board, inserting the shaped and reinforced board 24 into a heat-expanded sheath 92, lowering the temperature to shrink the sheath 92, removing trapped air from the sheath 92 and sealing the sheath 92.

Thus, while there are naturally many variations of aquatic body boards and methods for producing them, nevertheless there is still a need for a reliable, long-lasting aquatic body board that is sufficiently rigid, able support a user in stable fashion in water, smoothly glide along water when in use with minimal friction and, at the same time, easily and efficiently produced using a minimal amount of material and readily-available equipment. Furthermore, ease of decorating a top surface of the board would provide additional benefits by enhancing both marketing of the board and even use of the board, especially by children, to facilitate aquatic training and safety.

SUMMARY OF THE INVENTION

Accordingly, it is an object of the present invention to provide a new and improved aquatic device such as a flotation board.

It is a more specific object of the present invention to provide a reliable, long-lasting aquatic device that will withstand aquatic conditions during use.

It is a further object of the present invention to provide an aquatic device that can be easily manufactured from readily-available material and using readily-available manufacturing equipment.

It is another object of the present invention to, enhance aquatic training and safety by encouraging use of an aquatic device such as a body board, especially by children.

These and other objects are attained by the present invention which is directed to an aquatic flotation device including an outer covering having a first side and a second side substantially continuously joined to define a void volume within the covering. The void volume contains a quantity of foam material having a density less than water and sufficiently disposed within the void volume to provide a substantially rigid shape of the device by placing the outer covering under tension. One of the first and second sides of the covering is formed from a polymeric sheet material joined to a remainder of the covering. In particular, the first and second sides of the covering are each joined to an intermediate edge portion interconnecting the two and which can also be formed from flexible fabric material.

The inventive device is manufactured by forming the outer covering with one surface formed from a polymeric sheet and the other surface formed from selected materials, placing a pre-selected amount of foamable material within the covering which is then placed within a cavity of a mold defining the final shape of the device, i.e., body board, then heating the mold to cause the foamable material to expand and fill the covering which is thereby placed under tension, so as the mold cavity is ultimately cooled, the finished body board will retain its defined, molded shape.

In a preferred embodiment of the present invention, the edge portion is interconnected to both the first and second sides of the covering by stitching extending essentially around the perimeter of the board. In particular, the second side formed of a polymeric sheet is stitched within the edge portion, i.e., the edge portion overlaps around the outside of the polymeric sheet. This structure especially ensures manufacture of a safe, durable aquatic board that will not break apart upon use.

The aquatic board of the present invention, having at least one side manufactured from a polymeric sheet, is efficiently manufactured, durable, and at the same time provides an opposite surface which can be easily decorated with a design prior to the board being molded. The polymeric sheet material provides a smooth slick surface to both facilitate movement of the body board through water and resist abrasion. By having an overall encompassing outer covering, the contained foam material is substantially protected from the environment and damage, e.g., from objects on the beach.

BRIEF DESCRIPTION OF THE DRAWINGS

The features of the present invention will be described in greater detail with reference to the accompanying drawings, in which.

DESCRIPTION OF THE PREFERRED EMBODIMENTS

Figure 1:
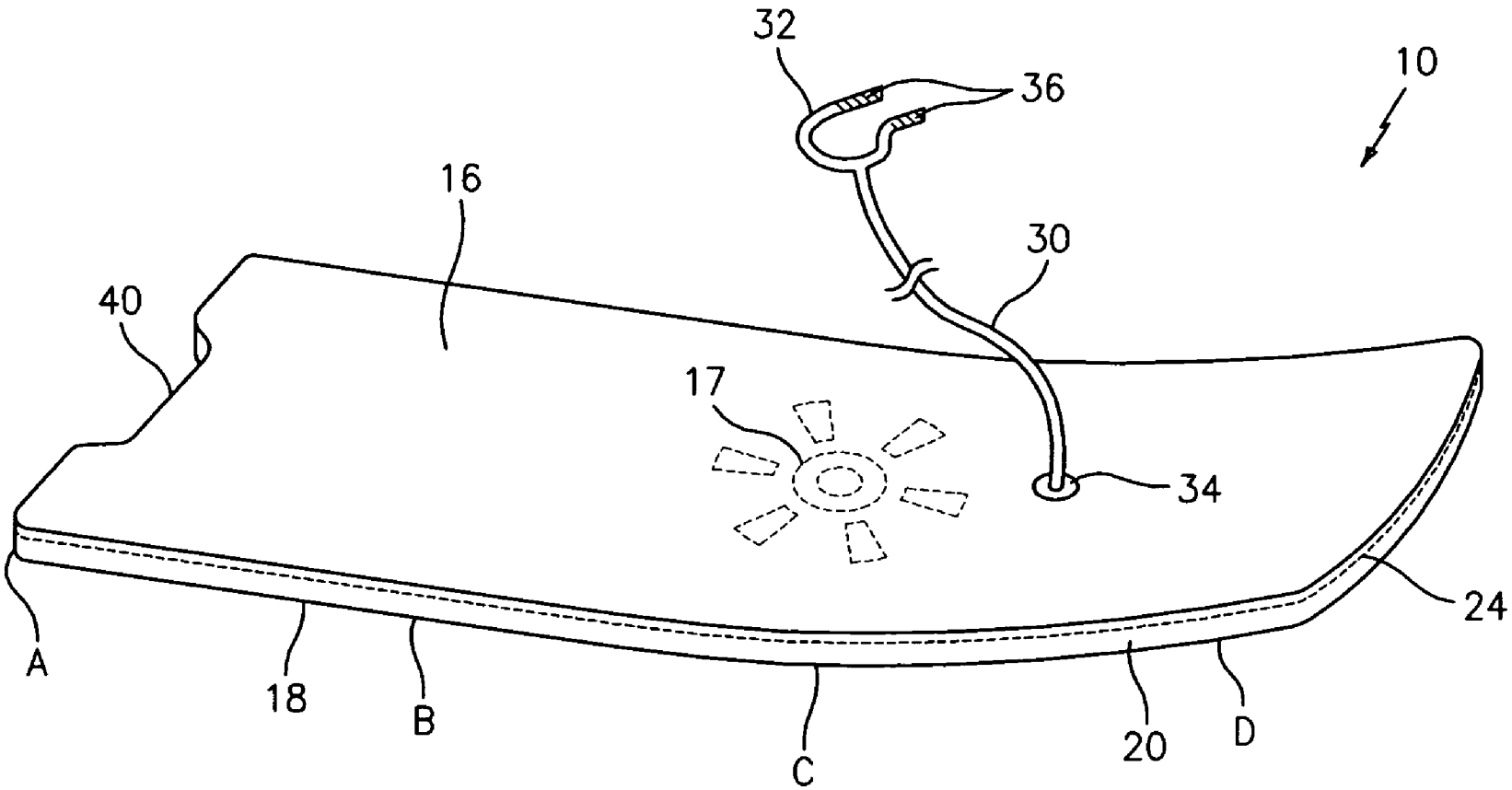
FIG. 1 illustrates a perspective view of the aquatic device according to the present invention.
Figure 2:
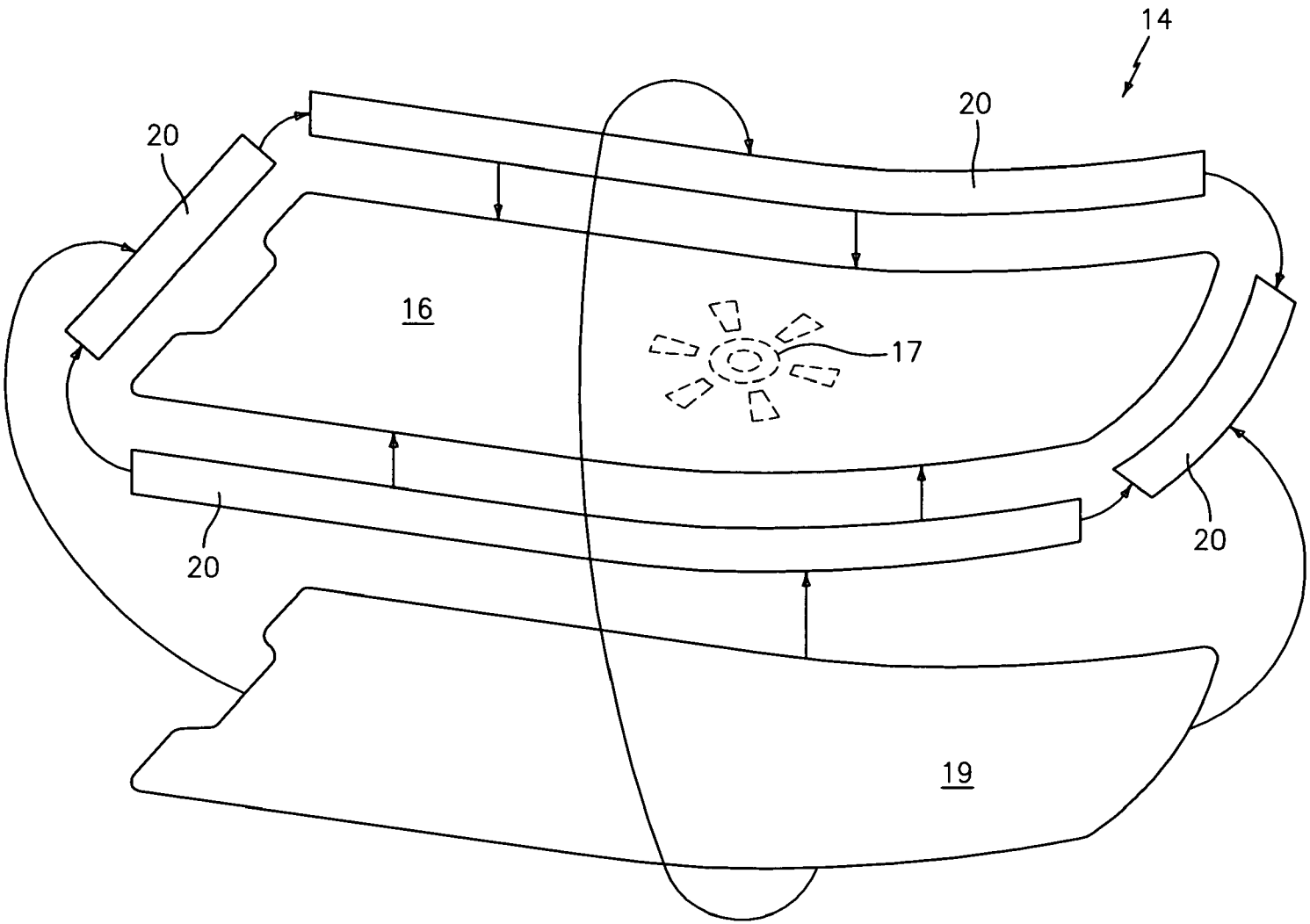
FIG. 2 illustrates an exploded schematic view of the components forming the outer covering of the aquatic device shown in FIG. 1 and the interconnecting thereof.
Figure 3:
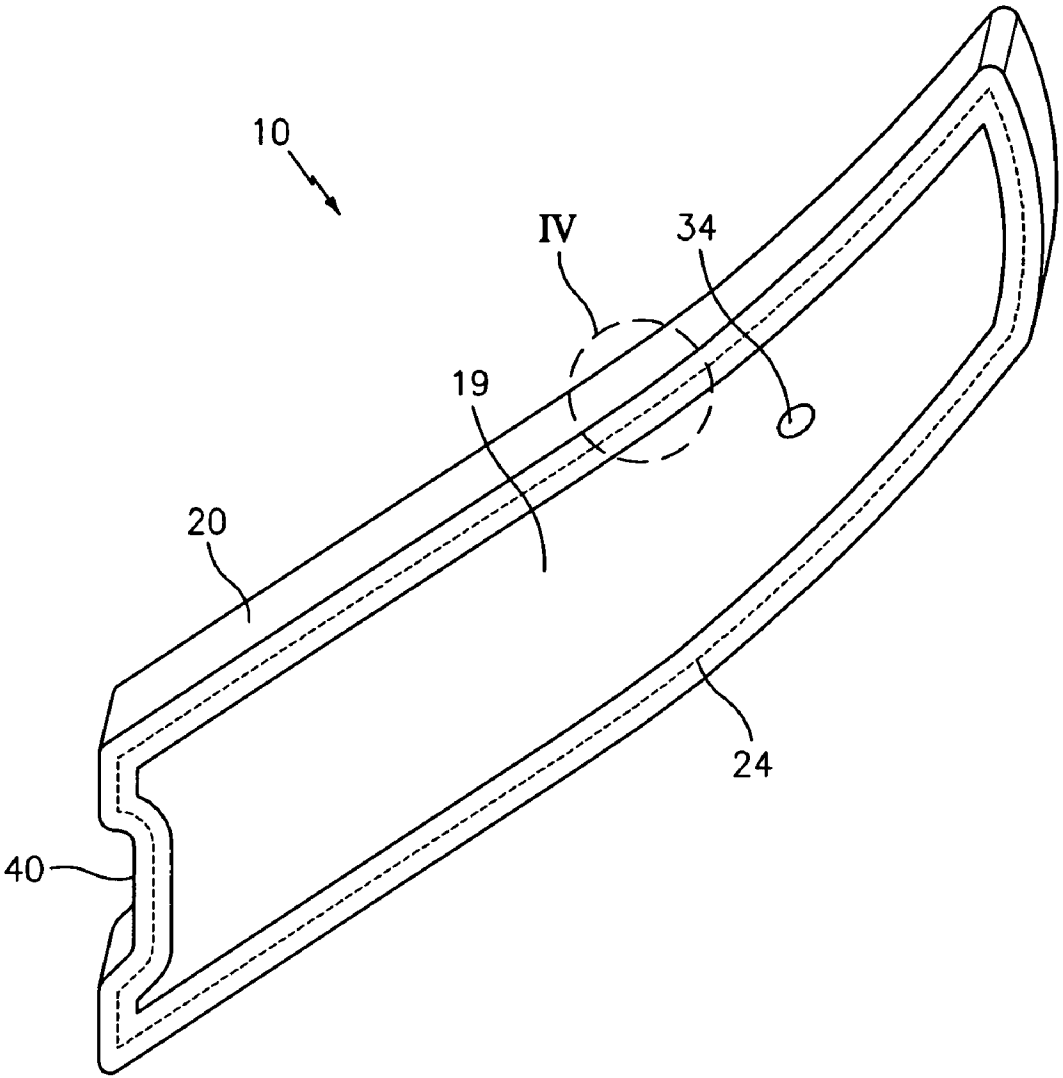
FIG. 3 illustrates a perspective view of the underside of the aquatic device shown in FIG. 1.

Referring to FIGS. 1-3, an aquatic body board 10 useful as a flotation aid includes an outer covering 14 having a first side 16 and a second side 18. First side 16 and second side 18 are substantially continuously joined by an edge portion 20 extending around the perimeter of the board 10, thereby defining a void volume. A sufficient quantity of foam material of density less than water fills the void volume and places the outer covering under tension so that the body board 10 possesses a substantially rigid shape. At least one of the sides 16 and 18, preferably the second lower side 18 of the outer covering 14, is formed from a polymeric sheet material 19.

Preferably, first side 16 and edge portion 20 of the outer covering 14 are formed from a flexible fabric material selected from the group consisting of woven fabric, non-woven fabric and combinations thereof. The flexible fabric material is preferably selected from the group consisting of cotton, polyamide, polyethylene, polyester, viscose, polypropylene, polyethylene terephthalate, copolymers thereof and blends thereof in any combination. In particular, the flexible fabric selected for the first side 16 is a polyester 190T woven fabric (available from Wujiang Xiangxing Textile Co., Ltd., Jiangsu Province, China) and the flexible fabric selected for edge material 20 is a polyethylene non-woven fabric having a shrinkage coefficient upon heating to temperatures during molding similar to the shrinkage coefficient for the polymeric sheet material 19 forming second or bottom side 18.

Furthermore, in an especially-preferred embodiment, the flexible fabric material used for first top side 16 includes a decorative design 17 prepared by at least one of weaving, screened coating, printing, embroidery, embossing and debossing. The design 17 is disposed to be readily visible upon the top surface 16 of the board 10 and easily applied to the fabric prior to being incorporated into the covering 14, e.g., by any of the conventional methods enumerated supra for applying decorations to cloth. Thus, there is no need to attempt to apply or attach a design to foam material forming the board 10.

The polymeric sheet 19 is preferably selected from the group consisting of polyethylene, polypropylene, copolymers of polyethylene and polypropylene, polytetrafluoroethylene, acrylonitrile butadiene styrene, polyvinylchloride, polystyrene and mixtures/blends thereof. In particular, the polymeric sheet 19 is an extruded polyethylene sheet having a thickness between about 0.4 mm. to about 0.8 mm; most preferably, the thickness is about 0.6 mm. Polymeric sheet 19 may be cut to the desired size and shape by a laser knife, shears, die-cutting or other known methods of sizing and shaping. Die-cutting is the preferred mode of shaping the polymeric sheet 19.

Polymeric sheet 19 can be joined to the edge fabric material 20 by a heat-welded bond, a sonic-welded bond, a sewn seam, a solvent weld bond, an adhesive bond, or any combinations thereof. In a preferred embodiment, the polymeric sheet 19 is joined to the edge fabric material 20, and edge fabric material 20 in turn joined to first side material 16, by one or more seams 24 formed by sewing with thread formed from a material selected from the group consisting of cotton, linen, viscose, polypropylene, polyethylene, copolymers of polypropylene and polyethylene, polyester, polyamide, and blends thereof. Sewn seams 24 are preferably composed of stitches having from about one to about five stitches per centimeter. This particular embodiment wherein the top 16, bottom 18 and edge 20 portions are interconnected by sewn seams, is especially durable and, at the same time, efficiently manufactured at low cost.

Figure 4:
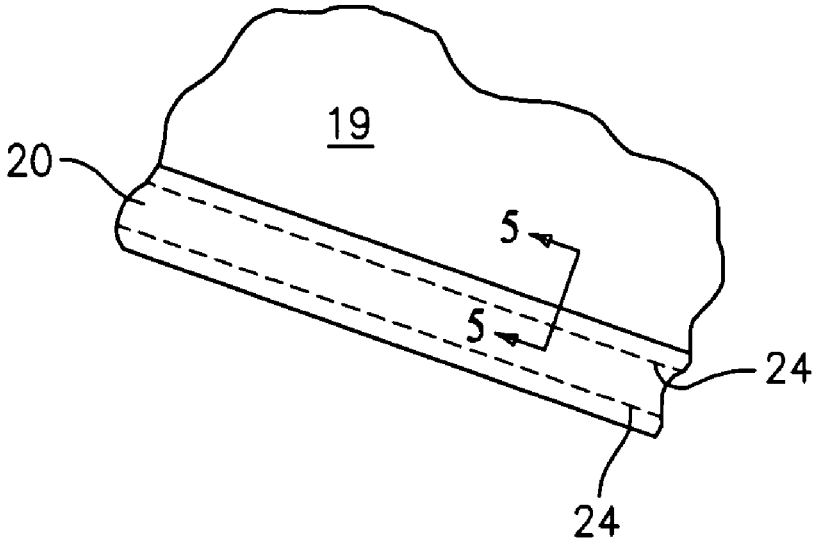
FIG. 4 illustrates an enlarged partially broken away view of the encircled area IV in FIG. 3.
Figure 5:
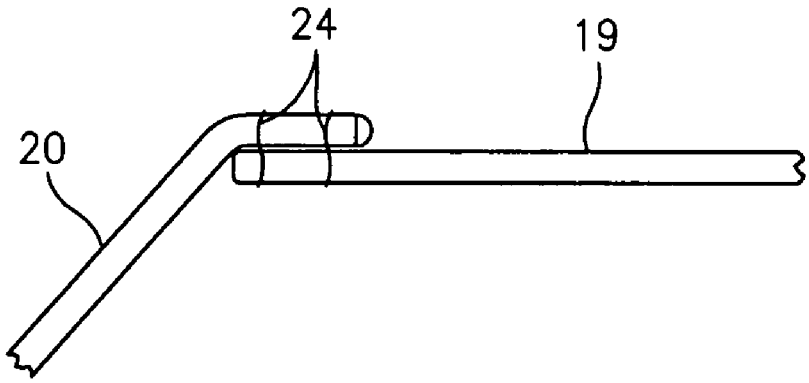
FIG. 5 is a sectional view taken along line 5-5 in FIG. 4.

In particular, as shown in FIGS. 4 and 5, the polymeric sheet 19 is sewn within the edge portion 20 of the covering 14, i.e., the edge portion 20 overlaps the outside of the polymeric sheet 19 when viewed from the underside in assembled condition of the board or device 10. This especially ensures manufacture of a safe, durable flotation aid that will not break apart upon ordinary aquatic conditions and impact. For example, when the edge of the polymeric sheet 19 is stitched inside the sewn fabric edge 20 as shown in FIGS. 4 and 5, the sheet 19 is less likely to become caught upon objects on the beach and cracked or split away from the sewn seams 24. The polymeric sheet 19 forming part of the covering 14 is not bonded to the interior foam material or another fabric, thus avoiding the problem of the polymeric sheet peeling off the foam or fabric. At the same time, the polymeric sheet structurally and mechanically forms part of the covering 14 and is maintained, together with the sewn seams 24, under the same degree of tension as the rest of the covering 14. Furthermore, when the fabric materials are heat-cut, the resultant fused edge imparts additional strength the sewn seam 24.

The foamed material used to form the board 10 may be selected from any known polymeric material which will foam to have density less than water, upon heating. Preferably, the foam material is expanded polystyrene, e.g., in the form of beads and which possesses a final foam density of about 2.2 pounds per cubic foot. Several illustrative but non-limiting examples of sizes and shapes of boards prepared in accordance with the present invention, are listed in Table I infra. For other shapes, densities and sizes, different amounts of expanded polystyrene or other suitable foamable materials may be preferred and are considered within the scope of the present invention:

TABLE I

| Shape | Size (cm) | Fill Weight (g) |
|---|---|---|
| Round | Diameter 62 | 400 ± 20 |
| Rectangular | 83 × 45 × 5 | 420 ± 25 |
| Rectangular | 94 × 47 × 5 | 500 ± 25 |
| Rectangular | 102 × 48 × 5.5 | 600 ± 30 |

The aquatic body board 10 preferably includes a tether strap 30 formed from a light, strong web material and fastened to the board 10. The board 10 may have an aperture extending therethrough between the top 16 and bottom 18 sides, through which a fastener 34 can be attached for affixing the strap 30 to the board 10. Tether strap 30 preferably includes a selectively-adjustable and closable loop 32 for attaching the strap 30 to, e.g., an arm or leg of a user. Loop 32 may be closed by a buckle and strap, tie or any other known fastening system, with a hook and loop fastener 36 being especially preferred.

Tether strap 30 is of length sufficient to allow free, unencumbered use of the board 10 while the strap 30 is secured, e.g., to an arm or a leg of a user. This improves safety upon use by preventing the board 10 from separating and drifting away from a user, e.g., a child, in the water. The board 10 preferably contains a recess 40 positioned for receiving the tightly-coiled tether strap 30 when not in use, thereby allowing the board 10 to be wrapped in a protective film for shipping and shelf-storage prior to distribution and sale.

Referring to FIG. 1, the letters A, B, C and D denote locations along the board 10 and generally divide the board 10 into thirds. Preferably, a rectangularly-shaped board 10 as illustrated in FIG. 1 has an upward curve from approximately locations C to D, the front of the board 10 when in use. The board 10 can also vary in thickness between sides 16 and 18 from locations A to D, especially boards 10 having a length of 94 cm. or 102 cm. More particularly, the 94 cm. length board 10 preferably has a thickness of about 3 cm. at location D and about 2.5 cm. at location A. The 102 cm. length board preferably has a thickness of about 3.25 cm. at location D and about 3 cm. at location A. Other variations in curvature and thickness are possible for particular requirements and within the scope of the present invention.

Figure 6:
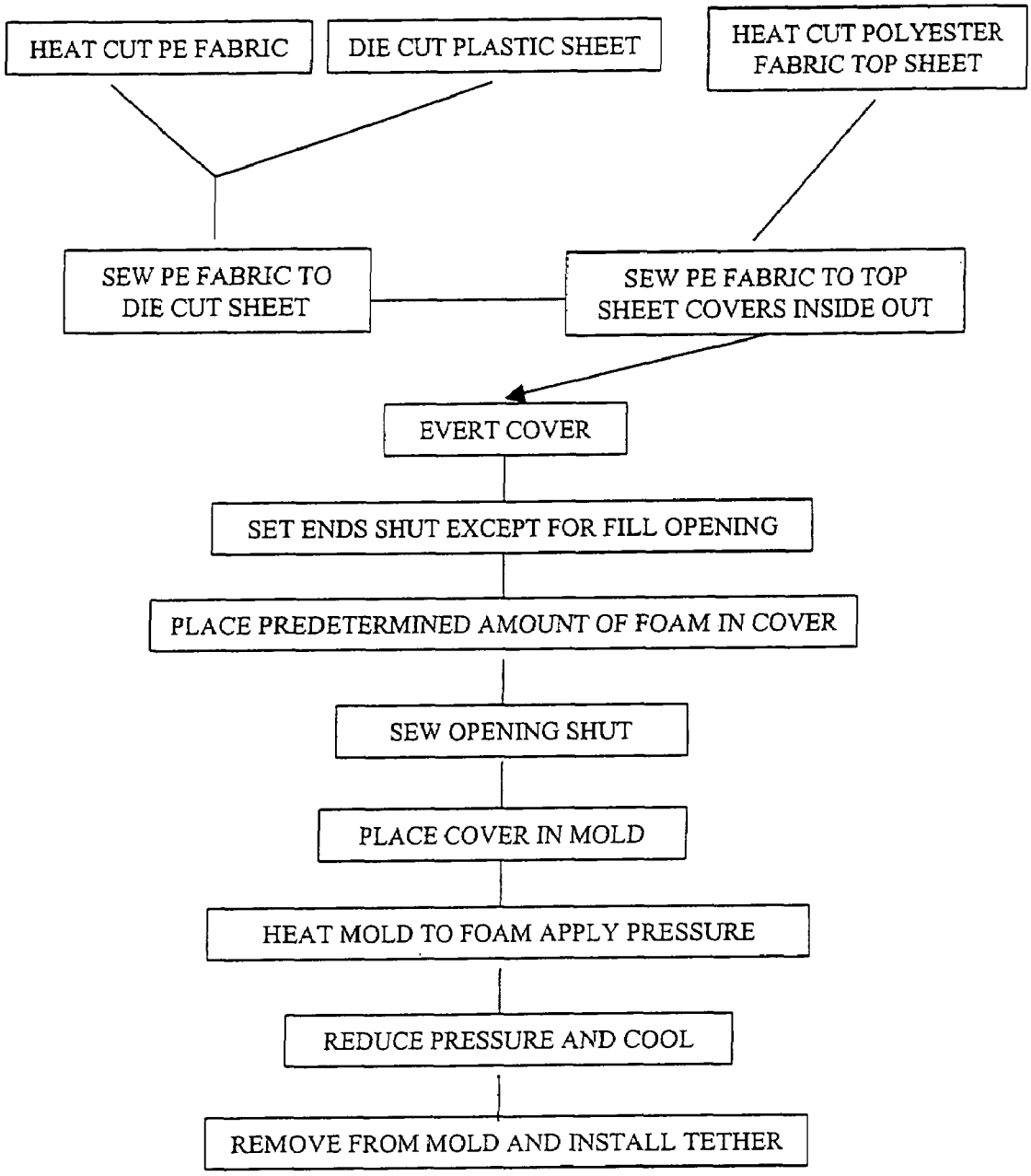
FIG. 6 illustrates a schematic block diagram of a method of making the inventive aquatic board.

A method of manufacturing the aquatic board 10 is schematically illustrated in FIGS. 2 and 6 and includes selecting a flexible fabric material for the top side 16 from the group consisting of cotton, polyamide, polyethylene, polyester, viscose, polypropylene, polyethylene terephthalate, copolymers thereof and blends thereof. The flexible fabric is cut to preselected shape using a heat cutting process so that a cut edge of the fabric is substantially heat-fused, thereby substantially reducing fraying of the fabric.

A polymeric sheet material is then selected for the bottom side 18 having a heat shrinkage coefficient substantially similar to the flexible fabric material and selected from the group consisting of polyethylene, polypropylene, copolymers of polyethylene and polypropylene, polytetrafluoroethylene, acrylonitrile butadiene styrene, polyvinylchloride and polystyrene, followed by cutting the polymeric sheet into a preselected shape by a die-cutting process. Outer covering 14 is then formed with one side being the polymeric sheet material 19 substantially continuously joined by and edge portion 20 to the flexible fabric forming the top side 16. The edge portion 20 is also formed from a flexible fabric material. In FIG. 6, the term "PE" denotes polyethylene.

More specifically, the polymeric sheet material 10, edge portion 20 and flexible fabric 16 are respectively secured together by an attachment selected from at least one of a heat-welded bond, sonic welding, sewn seam, solvent weld bond, an adhesive bond and combinations thereof, thereby defining a partially enclosed void volume having at least one opening through the covering for filling foamable material. In particular, the polymeric sheet 19 is joined to edge portions 20, in turn joined to top flexible fabric 16 in the direction of the various arrows in FIG. 2, e.g., by sewing seams 24 to form outer covering 14.

In this regard, edge portion 20 is preferably sewn to polymeric sheet 19 along a longitudinal direction to form a tube open at both ends. The tube is then everted so that the covering 14 is in its final disposition with any decoration or design 17 present on the exposed surface of the top side 16. In particular, the polymeric sheet 19 is sewn to edge portion 20 along seam 24 such that when the covering 14 is everted, the edge portion 20 overlaps the outside of polymeric sheet 19. One end opening of the everted covering 14 is then closed, e.g., by sewing a seam 24, with a preselected amount of the foamable material (e.g., Polystyrene beads) then being filled into the void volume defined within the covering 14 through the opposite remaining opening which is then closed, e.g., preferably sewn shut, after completion of filling.

The filled outer covering 14 is then placed in a mold having the preselected shape of the finally-produced board 10 and which is then heated at sufficient temperature (preferably about 135° to about 150° C.) and pressure (preferably about 4 to about 5 $Kg/M^2$) for sufficient time (preferably about 8 seconds), followed by reducing the pressure to about 2 $Kg/M^2$ for about 12 seconds while maintaining the temperature. Then, the mold is cooled preferably to about 30° C. and maintained at this temperature for about 5 minutes. The finished board 10 is then removed from the mold and allowed to reach ambient temperature.

Tether 30 can then be fastened to the finished board 10 which is then covered with a protective overwrap prior to shipping and distribution.

The preceding description of the present invention is merely exemplary and not intended to limit the scope thereof in any way.

What is claimed is:

1. A method for manufacturing a flotation device, comprising the steps of selecting a flexible fabric material and cutting the same to minimize fraying, selecting a polymeric sheet having a heat shrinkage coefficient substantially similar to said flexible fabric material and cutting said sheet to a preselected shape, forming an outer covering having a first side composed of said flexible fabric material and a second side formed of said polymeric sheet by substantially continuously joining said first and second sides to an edge portion also formed of flexible fabric material, so that said outer covering defines a partially enclosed void volume having at least one opening, everting said outer covering and closing all remaining openings except for a fill opening, filling a preselected quantity of a heat expandable and curable material sufficient to form foam having a density less than water into said void volume through said fill opening and then closing said fill opening after completion of filling, placing said covering having said heat expandable material sealed therewithin into a molding cavity having a preselected shape conforming to the shape of the finished device, heating said molding cavity to a preselected temperature and pressure for a preselected time to expand and cure said filled material and place said outer covering under tension, and cooling said molding cavity to formed a shaped, substantially rigid device of density less than water.

2. The method of claim 1, wherein said first and second sides and edge portions are respectively joined by stitching.

3. The method of claim 1, wherein said edge portion is joined to overlap an outer surface or edge of said polymeric sheet.

4. The method of claim 1, comprising the additional step of placing a design upon an outer surface of said first side prior to forming said covering.

5. The method of claim 1, comprising the additional step of attaching a tether to said finished device.

* * * * *